United States Patent [19]

Sturdevan

[11] Patent Number: 4,824,385

[45] Date of Patent: Apr. 25, 1989

[54] RIGID SHEATH FOR A SPARK PLUG CABLE AND ITS ASSOCIATED BOOT

[75] Inventor: Ronald P. Sturdevan, Tifton, Ga.

[73] Assignee: Prestolite Wire Corporation, Farmington Hills, Mich.

[21] Appl. No.: 121,046

[22] Filed: Nov. 13, 1987

[51] Int. Cl.[4] ..... H01R 11/16; H01R 13/516

[52] U.S. Cl. ..... 439/128; 439/731; 439/476

[58] Field of Search ..... 439/125–128, 439/465, 467, 476, 481–484, 731, 904–906, 278, 279, 281–283, 587–589; 123/143 C, 169 P, 169 PA, 169 PH; 174/77 S, 138 S, 31 S; 313/135

[56] References Cited

U.S. PATENT DOCUMENTS 4,443,047 4/1984 Hofmann ..... 439/128

4,671,586 6/1987 DeBolt ..... 439/607

*Primary Examiner*—Gary F. Paumen

*Attorney, Agent, or Firm*—Remy J. VanOphem

[57] ABSTRACT

A rigid sheath for a spark plug cable and its associated boot is provided by combining two lockable components, each of which is mutually symmetrical along the axial direction. The rigid sheath includes a lower portion structured to interlock with the boot and an upper portion structured to route a portion of the spark plug cable through a bend of substantially 90° so that it is kept out of the way of structures within the engine compartment. Because the rigid sheath combines columnar strength, a handle and an interlocking relationship with the boot, easy installation and removal of the spark plug cable and its associated boot in relation to a spark plug is made possible, even where the spark plug is surrounded by nearby structures such as a deep well of the engine.

19 Claims, 2 Drawing Sheets

RIGID SHEATH FOR A SPARK PLUG CABLE AND ITS ASSOCIATED BOOT

BACKGROUND OF THE INVENTION

1. Field of the Invention

This invention relates to spark plug insulators, and more particularly to a rigid sheath for spark plug insulators that privides long reach capability, spark plug cable routing, and an installation and removal handle.

2. Description of the Prior Art

In modern automobiles, the internal combustion engine is often located in a compartment having very little unused space. In such situations, the spark plug cables must be frequently routed along rather sharp curves in order to ensure that body parts, such as the hood, are adequately cleared. Another situation frequently encountered in modern automobiles involves engines in which the spark plugs are located within deep wells of the engine, or in places that are rendered difficult to access because of nearby engine components. In these situations, it is difficult to properly seat the terminal of the spark plug cable and its associated boot onto the spark plug. FIG. 1 demonstrates this situation. A spark plug 10 is located in a well 12 of an engine block 14. A spark plug cable 16 is electrically connected with the spark plug and covered over at the connection location by an elastomer boot 18 which seals the connection from moisture. As can be seen from the figure, it is difficult to place the spark plug cable with its associated boot onto the spark plug because of interference by the well walls.

There have been a number of attempts in the prior art to devise a successful spark plug cable connection system.

One class of spark plug cable connection systems involves spark plug cable terminal protectors where the terminal is bent at an angle of 90° relative to the spark plug.

U.S. Pat. No. 1,245,931 to Lanman, is directed to the problem of a spark plug being subject to injury from falling objects and water short circuiting. Lanman solves this problem by providing an L-shaped metal sheath which clamps to both the spark plug cable and the spark plug.

U.S. Pat. No. 1,376,844 to Weber, is directed to the problem of making good electrical contact between the spark plug and the spark plug cable. Weber solves this problem by providing an L-shaped insulator having the spark plug cable at one end and at the other end an aperture into which the spark plug inserts, thereby making contact with the spark plug cable terminal.

U.S. Pat. No. 2,301,570 to Nowosielski, is directed to the problem of difficulty of making good mechanical and electrical connection of spark plug cables to spark plugs, as is required in aircraft engines. Nowosielski solves this problem by providing an electromagnetic shield, a cover, a wire piercing element, an insulator, and a bushing for the spark plug cable to pass through. The bushing coupled with the covering is designed to be permanently attached to the spark plug, and is not independent of the spark plug cable.

U.S. Pat. No. 2,323,399 to Jacobi, is directed to the problem of electromagnetic wave propagation from spark plug terminals. Jacobi solves this problem by using a shield composed of two layers: an inner rubber shield and an outer conductive rubber shield.

U.S. Pat. No. 2,383,805 to Mosthaf, is directed to the problems encountered in aircraft engine operating environments. Mosthaf solves these problems by providing a sheathing of kiln fired ceramic over the spark plug cable and the spark plug upper end.

U.S. Pat. No. 2,686,511 to Platner, is directed to the problem of spark plug terminal shields being blown off during engine operation. Platner solves this problem by providing a cover over the spark plug. A steel shield within the covering has axially positioned therein the spark plug cable which is covered by a ceramic.

U.S. Pat. No. 4,443,047 to Hofmann, is directed to the problem of the spark plug terminal becoming deformed during removal from the spark plug. Hofmann solves this problem by providing a two-piece L-shaped boot covering. The boot covering conforms to the already present shape of the boot and the direction of the spark plug cable and supplies a handhold to aid removal from the spark plug.

A second class of spark plug cable connection systems involves protectors for spark plug cable terminals which are straight (that is, 180°) in relation to the spark plug.

U.S. Pat. No. 2,685,872 to Berstler, is directed to the problem of electrical leakage from spark plugs. Berstler teaches that this can be solved by using a two part insulator surrounding the spark plug components. Specifically, his teachings are directed to an improved type of spark plug, wherein a base insulator is made of a machinable material and an upper insulator is made of a cheaper type of insulator material.

U.S. Pat. No. 3,076,113 to Candelise, is directed to the problem of loss of dielectric effectiveness of the spark plug cable boots over time. Candelise solves this problem by providing, interior to the spark plug itself, the spark plug cable terminal. A protective rubber boot is also provided.

U.S. Pat. No. 3,128,139 to Estes, is directed to the problem of electromagnetic waves emanating from the spark plug. Estes teaches that this problem may be solved by providing a metallic shield over the spark plug cable terminal attachment area.

U.S. Pat. No. 3,803,529 to Rohrig et al, is directed to the problems associated with spark plug terminals in which moisture and conductor kinking can occur. Rohrig et al solve these problems by providing two insulating layers, one a body and the other a casing, both made of thermal setting material, with an elastomeric material filling in any gaps therebetween. An end portion is made a metal shield.

U.S. Pat. No. 3,914,003 to Loy, is directed to the problem of the interior of the spark plug terminals becoming brittle and deteriorating over time. Loy solves this problem by providing an exterior thermal setting plastic and an interior elastomeric plastic. Loy surrounds the upper extremity of the spark plug with the thermal setting plastic, using the elastomeric plastic to protect only the spark plug cable conductors.

U.S. Pat. No. 4,621,881 to Johansson et al, is directed to the problem of prior art elastomer boots being of a size which causes a tight fit with the spark plug, resulting in difficulty during removal therefrom. Johansson et al solve this problem by providing a stiff material which surrounds an elastomeric material. The elastomeric material extends between the upper end of the spark plug to the beginning of the spark plug cable, but is not co-extensive with the spark plug cable. The outer material combines with the inner material only for sealing purposes.

Devices have been developed to protect electrical connections by means of a shield against both operational and environmental problems.

U.S. Pat. No. 3,845,459 to Normann, is directed to the problem of female sockets suffering from dielectric breakdown and mechanical fatigue from insertion of oversized male connectors. Normann solves this problem by providing a bridged insulator which surrounds the female electrical connector. A suggested material is Teflon. This invention, through not specifically directed to spark plug wires, is of interest for showing a rigid dielectric covering over the electrical contact.

U.S. Pat. No. 4,614,392 to Moore, is directed to the problem of protecting an electrical connection from well fluids. Moore solves this problem by providing an elastomer covering which snaps together. The covering has an outer protective skin.

None of the above cited references teach a solution to the problems encountered with modern autombiles enumerated above. Accordingly, there remains in the art the need for a rigid covering for a spark plug cable and its associated boot which provides for a long reach capability, spark plug cable routing and an installation and removal handle.

SUMMARY OF THE INVENTION

The invention is a rigid sheath for a spark plug cable and its associated boot. Provided is a first sheath component having a lower portion for receiving a first portion of the boot and an upper portion for receiving a first portion of the spark plug cable. A second rigid sheath component having a lower portion for receiving the remaining portion of the boot and an upper portion for receiving a second portion of the spark plug cable is also provided. The second rigid sheath component is joinable to the first rigid sheath component to form a rigid sheath having a lower portion for receiving the boot and an upper portion for receiving a predetermined portion of the spark plug cable. The first rigid sheath component is retainable in joined relation with the second rigid sheath component.

Accordingly, it is an object of the invention to provide a rigid sheath for a spark plug cable and its associated boot which gives columnar strength thereto, permitting easy and effective installation and removal of the spark plug cable with its associated boot in relation to the spark plug.

It is a further object of the invention to provide a rigid covering for a spark plug cable and its associated boot which is uncomplicated and easy to install.

It is yet a further object of the invention to provide a spark plug cable routing capability which definitely defines the spark plug route along even, sharp angular paths, such as 90°.

It is still a further object of the invention to provide an installation and removal handle structure for a spark plug cable and its associated boot.

It is yet an additional object of the invention to provide a rigid sheath covering for a spark plug cable boot which has elongated slots for engaging with ribs on the boot as an aid in freeing the boot from its seal with the spark plug.

These and other objects, advantages, features, and benefits of the invention may become apparent from the following specification.

DETAILED DESCRIPTION OF THE PREFERRED EMBODIMENTS

Figure 1:
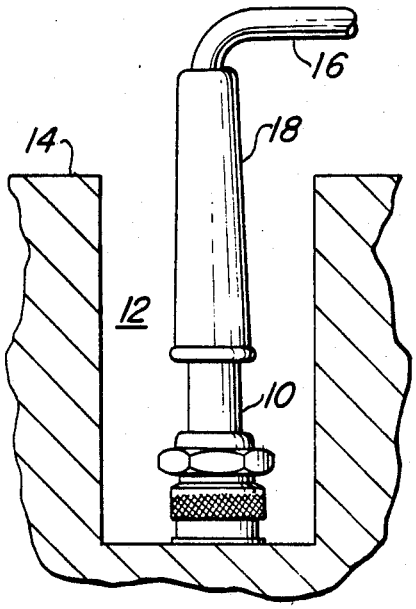
Fig-1 PRIOR ART
FIG. 1 is a prior art spark plug cable and its associated boot in use on a spark plug located in an engine well.
Figure 2:
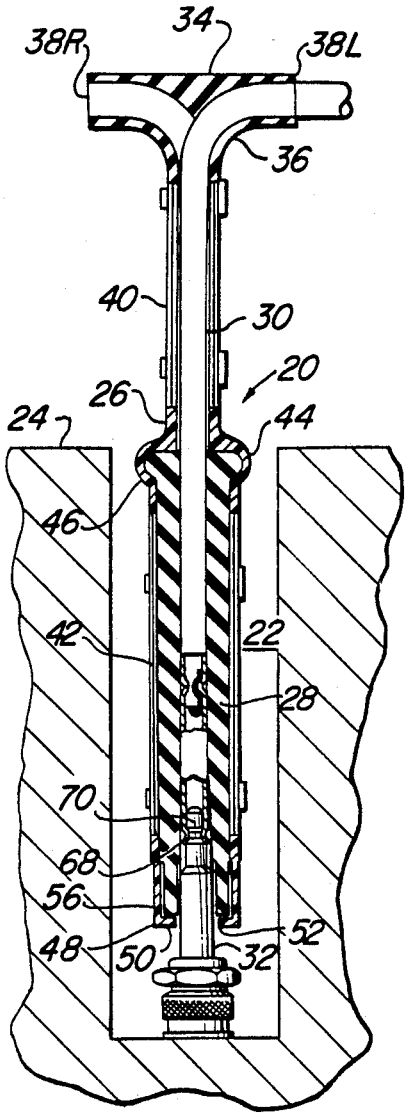
FIG. 2 is a cross-sectional side view of the invention in use in a deep engine well.

Referring now to the figures, FIG. 2 shows the invention 20 in use within a deep well 22 of an internal combustion engine 24. The invention is a rigid sheath 26, composed of a thin, rigid material such as Nylon or plastic, which covers both an elastomer boot 28 as well as a portion of its associated spark plug cable 30. The invention 20 serves to provide columnar strength to both a portion of the spark plug cable 30 and its associated boot 28 so as to permit proper seating with a spark plug 32 even when the spark plug is located in a confined space, such as the engine well 22. The rigid sheath according to the invention further has a "T" shaped handle 34 which facilitates installation and removal of the spark plug cable and its associated boot in relation to the spark plug. Because the invention is in the form of a rigid sheath, it further serves to provide a definite route for the spark plug cable. This route includes a substantially 90° turn 36 within the "T" shaped handle 34 permitting clearance for automotive components, such as an automobile hood. The spark plug cable can exit from either of the ends 38R or 38L of the "T".

The diameter of the interior space within the rigid sheath 26 corresponds in its upper portion 40 to an inside diameter that is just slightly larger than that of the outside diameter of the spark plug cable 30. The diameter of the interior space of the rigid sheath 26 corresponds in its lower portion 42 to an inside diameter that is just slightly larger than that of the outside diameter of the boot 28.

Figure 6:
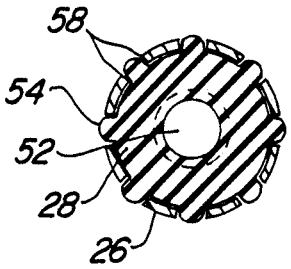
FIG. 6 is an end view along lines 6—6 in FIG. 5 of the rigid sheath according to the invention.

The lower portion 42 of the rigid sheath 26 interlocks with the boot 28 to ensure that the boot will follow the rigid sheath during any movement of the rigid sheath that is used to break the boot seal with the spark plug 32. There are several locations where this occurs: firstly, at the uppermost end of the lower portion of the rigid sheath 26, an annular lip 44 of the boot 28 is surrounded by an annular concave portion 46 of the rigid sheath. Secondly, at the lowermost end 48 of the rigid sheath 26, an annular flange 50 on the rigid sheath serves to confine the boot; an aperture 52 in the flange 50 allows the spark plug 32 to pass therethrough into the boot. Thirdly, a plurality of axially oriented ribs 54 on the boot at its lowermost end 56 interlock with opposing axially oriented elongated slots 58 in the surface of the rigid sheath 26 adjacent the annular flange 50; this is shown in detail in FIG. 6. All of these aforesaid interlocking relationships between the rigid sheath 26 and the boot 28 cause the boot to be trapped in the rigid sheath and move correlatively with each movement of the rigid sheath. Because of the aforesaid interlocking relationship, twisting, pulling, and puching movements applied to the rigid sheath are transferred directly to the boot. Accordingly, the boot can be both removed from, and inserted onto, the spark plug with considerable ease, even in situations where the spark plug is surrounded by nearby structures rendering access thereto very difficult.

Figure 3:
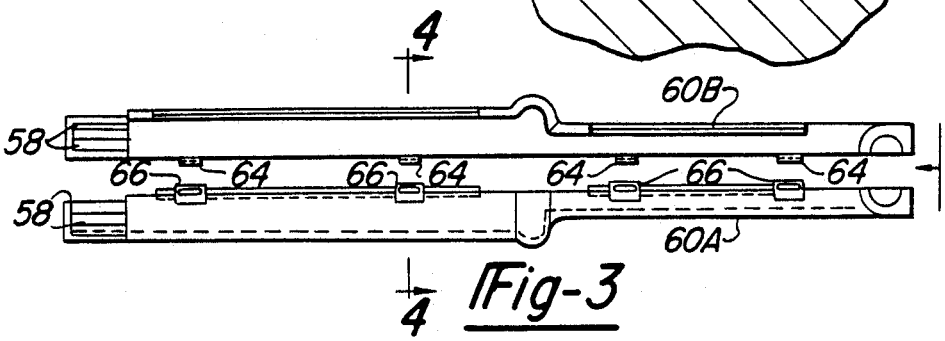
FIG. 3 is a side view of the two symmetrically identical components about to be laterally joined to form the rigid sheath according to the invention.
Figure 4:
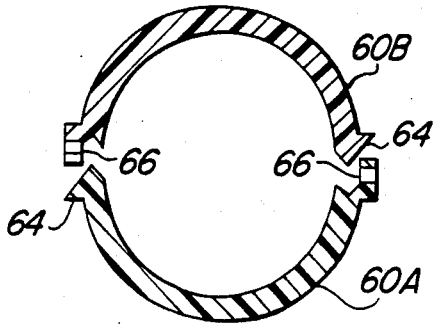
FIG. 4 is a sectional view along lines 4—4 in FIG. 3 of the two symmetrically identical components about to be laterally joined to form the rigid sheath according to the invention.
Figure 5:
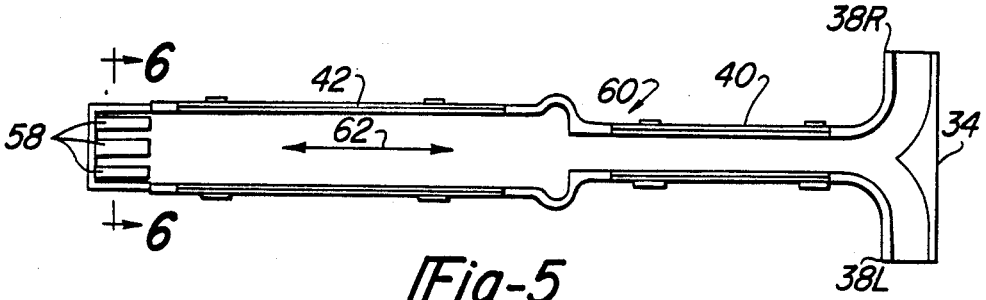
FIG. 5 is a side view of the two symmetrically identical components joined to form the rigid sheath according to the invention.

The rigid sheath 26 is constructed of two components 60A and 60B, each of which is symmetrically identical with respect to the other along the axial dimension 62 of the rigid sheath. FIG. 3 shows the two components 60A and 60B mutually positioned for lateral joining into the rigid sheath 26. It will be seen from FIGS. 3 and 4 that a plurality of clips 64 and slots 66 are provided on each of the components 60A and 60B in order to mechanically interlock the two components when they are laterally joined to each other. FIG. 4 shows, in cross-section, the two components 60A and 60B, in position for lateral joining. FIG. 5 shows the rigid sheath 26 after the two components 60A and 60B have been laterally joined.

Figure 7:
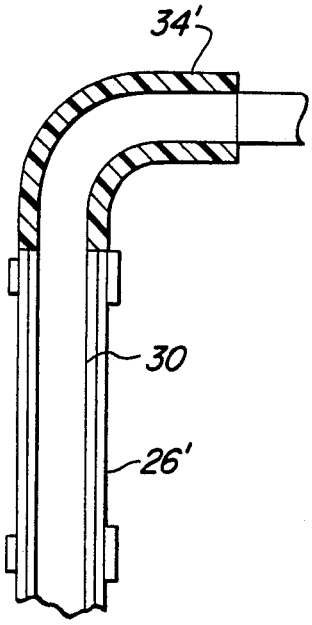
FIG. 7 is a cross-sectional side view of the invention showning an alternative embodiment incorporating an "L" shaped handle.

FIG. 7 shows an alternative embodiment of the invention, where the "T" shaped handle 34 is now substituted with an "L" shaped handle 34'. In all other respects, the rigid sheath 26' remains the same as the rigid sheath 26 as described above.

The operation of the invention will now be explained. The two components 60A and 60B are brought into mutually aligned position as shown in FIG. 3. The spark plug cable 30 and its associated boot 28 are positioned between the components 60A and 60B. The spark plug cable and its associated boot are then placed into one of the two components 60A and 60B, with the spark plug cable routing out of one of the ends 38L or 38R of the "T" shaped handle 34. Now, the other of the two components 60A and 60B is brought into laterally joined engagement with the component having already received a portion of the spark plug cable and its associated boot. A pressing action along the component 60A and 60B causes the clips 64 to snap into the receiving slots 66, thereby sealing the spark plug cable and its associated boot within the rigid sheath 26. It is preferred that the clip action be releasable, so that the component 60A and 60B can be non-destructively separated after joining. The embodiment shown in FIG. 7 is operated in exactly the same manner, where the "L" shaped handle 34' now offers only one route for the spark plug cable to exit.

To install the spark plug cable with its associated boot onto the spark plug 32, a mechanic grabs the "T" shaped handle 34, or the "L" shaped handle 34', and thereby guides the rigid sheath onto the spark plug. A pressing action, combined with a twisting action if desired, causes a spark plug cable terminal 68 to electrically connect with a spark plug electrode 70 and the boot 28 to properly seal over this connection point. Because of the bend 36 in the rigid sheath, the spark plug cable will be routed safely and positively away from any possible interference with objects in the engine compartment.

To remove the spark plug cable and its associated boot from the spark plug, the mechanic again grabs the "T" shaped handle 34, or "L" shaped handle 34', and pulls upwardly, while at the same time twisting. Because of the interlocking relationship between the rigid sheath 26 and the boot 28, this twisting action causes the seal of the boot with the spark plug to be broken, permitting the spark plug cable and its associated boot to be easily removed from the spark plug.

To those skilled in the art to which this invention appertains, the above described preferred embodiment may be subject to change or modification. Such changes or modifications can be carried out without departing from the scope of the invention, which is intended to be limited only by the scope of the appended claims.

What is claimed is:

1. A rigid sheath for a spark plug cable and its associated boot, comprising:

a first rigid sheath component having a lower portion for receiving a first portion of said boot and an upper portion for receiving a first portion of said spark plug cable;

a second rigid sheath component having a lower portion for receiving the remaining portion of said boot and an upper portion for receiving a second portion of said spark plug cable, said second rigid sheath component being joinable with said first rigid sheath component to form said rigid sheath having a lower portion for receiving and intimately contacting said boot and an upper portion adjacent said lower portion for receiving a predetermined portion of said spark plug cable;

means for retaining said first rigid sheath component in a joined relation with said second rigid sheath component;

interlocking means located between said rigid sheath and said boot for providing correlative movement between said rigid sheath and said boot as said rigid sheath is mounted to or demounted from said spark plug; and a handle attached to the upper portion of said rigid sheath, said handle having at least one apertured end for communicating with said upper portion of said rigid sheath, said at least one apertured end being adapted to receive said spark plug cable from said upper portion of said rigid sheath, such that said handle directs said spark plug cable in a predetermined direction.

2. The rigid sheath of claim 1, wherein said interlocking means comprises: a first set of axially oriented ribs on an outer surface of said boot and a set of axially oriented slots on an inner surface of said rigid sheath, said sets of axially oriented slots and axially oriented ribs being in a mutually interlocking relationship.

3. The rigid sheath of claim 2, wherein said interlocking means comprises an apertured annular flange provided at a lowermost portion thereof, said apertured annular flange being adjacent one end of said boot.

4. The rigid sheath of claim 3, wherein said boot has an annular lip at its other end; and said rigid sheath has a concavely shaped portion; said interlocking means comprising said concavely shaped portion of said rigid sheath surrounding said annular lip of said other end of said boot.

5. The rigid sheath of claim 4, wherein said means for retaining said first rigid sheath component in said joined relation with said second rigid sheath component is releasable.

6. The rigid sheath of claim 5, wherein said means for retaining said first rigid sheath component in said joined relation with said second rigid sheath component is a plurality of interlocking clips and slots located along a common plane.

7. The rigid sheath of claim 5, wherein said means for retaining said first rigid sheath component in said joined relation with said second rigid sheath component further includes a "V" shaped groove along a portion of one edge of each of said first and second rigid sheath components and a "V" shaped protrusion along a corresponding portion of the other edge of each of said first and second rigid sheath components such that said "V" shaped protrusion is seated in said "V" shaped groove when said first and second rigid sheath components are in said joined relation.

8. The rigid sheath of claim 1, wherein said handle is a "T" shaped handle at an uppermost portion of said rigid sheath, said "T" shaped handle having at least two apertured ends each of which communicate with said upper portion of said rigid sheath so that said spark plug cable may be received in said upper portion and exit from one of said apertured ends of said "T" shaped handle.

9. The unitary rigid sheath of claim 1, wherein said handle is an "L" shaped handle at an uppermost portion of said rigid sheath, the end of said "L" shaped handle having an aperture communicating with said upper portion of said rigid sheath so that said spark plug cable may be received in said upper portion and exit from said aperture at the end of said "L" shaped handle.

10. A rigid sheath for a spark plug cable and its associated boot, comprising:

a first rigid sheath component having a lower portion for receiving a first portion of said boot and an upper portion for receiving a first portion of said spark plug cable;

a second rigid sheath component having a lower portion for receiving the remaining portion of said boot and an upper portion for receiving a second portion of said spark plug cable, said second rigid sheath component being joinable to said first rigid sheath component along a common plane to form a rigid sheath having a lower portion intimately contacting said boot therein and an upper portion for receiving said spark plug cable;

means for retaining said first rigid sheath component in a joined relation with said second rigid sheath component;

means for interlocking said rigid sheath with respect to said boot for providing correlative movement between said rigid sheath and said boot whenever said rigid sheath is moved; and means for gripping said rigid sheath, said means for gripping being located adjacent said upper portion of said first and second rigid sheath components, said means for gripping having a guide passage therethrough for receiving said spark plug cable and providing a guide for directing said spark plug cable in a predetermined direction.

11. The rigid sheath of claim 10, wherein said interlocking means comprises a set of axially oriented ribs on an outer surface of said boot and a set of axially oriented slots on an inner surface of said rigid sheath, said sets of axially oriented slots and axially oriented ribs being in a mutually interlocking relationship.

12. The rigid sheath of claim 11, wherein said interlocking means comprises an apertured annular flange provided at a lowermost portion thereof, said apertured annular flange being adjacent one end of said boot.

13. The rigid sheath of claim 12, wherein said boot has an annular lip at its other end and said rigid sheath has a concavely shaped portion captivating said annular lip.

14. The rigid sheath of claim 13, wherein said means for retaining said first rigid sheath component in said joined relation with said second rigid sheath component is releasable.

15. The rigid sheath of claim 14, wherein said means for retaining said first rigid sheath component in said joined relation with said second rigid sheath component is a plurality of interlocking clips and slots.

16. The rigid sheath of claim 14, wherein said means for retaining said first rigid sheath component in said joined relation with said second rigid sheath further includes a "V" shaped groove along a portion of one edge of each of said first and second rigid sheath components and a "V" shaped protrusion along a corresponding portion of the other edge of each of said first and second rigid sheath components such that said "V" shaped protrusion is seated in said "V" shaped groove when said first and second rigid sheath members are in said joined relation.

17. The rigid sheath of claim 11, wherein said means for gripping further comprises a "T" shaped handle at an uppermost portion of said rigid sheath, said "T" shaped handle having two apertured ends each of which communicate with said upper portion of said rigid sheath so that said spark plug cable may be received in said upper portion and exit from one of said apertured ends of said "T" shaped handle.

18. The rigid sheath of claim 11, wherein said means for gripping further comprises a "L" shaped handle at an uppermost portion of said rigid sheath, said "L" shaped handle having an apertured end communicating with said upper portion of said rigid sheath so that a spark plug cable may be received by said upper portion and exit from said apertured end of said "L" shaped handle.

19. A rigid sheath for a spark plug cable and its associated boot, comprising:

a spark plug cable having a spark plug cable terminal mechanically and electrically connected thereto;

a boot for receiving at one end a spark plug, said boot receiving said terminal and a predetermined portion of said spark plug cable therein;

a first rigid sheath component having a lower portion for receiving a first portion of said boot, said first rigid sheath component further having an upper portion for receiving a first portion of said spark plug cable;

a second rigid sheath component having a lower portion for receiving the remaining portion of said boot and an upper portion for receiving a second portion of said spark plug cable, said second rigid sheath component being joined to said first rigid sheath component to form a rigid sheath having a lower portion intimately contacting said boot and an upper portion enclosing a predetermined portion of said spark plug cable;

a handle at an uppermost end of said rigid sheath, said handle having at least one apertured end communicating with said upper portion of said rigid sheath so that said spark plug cable is received in said upper portion;

means for retaining said first rigid sheath component in a joined relation with said second rigid sheath component; and interlocking means between said rigid sheath and said boot for providing correlative movement between said rigid sheath and said boot whenever said rigid sheath is moved, said interlocking means comprising:

a set of axially oriented ribs on an outer surface of said one end of said boot; a set of axially oriented elongated slots on an inner surface of said rigid sheath, said sets of axially oriented elongated slots and axially oriented ribs being in a mutually interlocking relationship;

an apertured annular flange attached to said rigid sheath at a lowermost portion thereof, said apertured annular flange being adjacent said one end of said boot; and an annular lip on the other end of said boot;

a concavely shaped portion spaced a predetermined distance from said apertured annular flange of said unitary rigid sheath, said concavely shaped portion of said unitary rigid sheath captivating said annular lip on the other end of said boot.

* * * * *

UNITED STATES PATENT AND TRADEMARK OFFICE

CERTIFICATE OF CORRECTION

PATENT NO. : 4,824,385

DATED : April 25, 1989

INVENTOR(S) : Ronald P. Sturdevan

It is certified that error appears in the above-identified patent and that said Letters Patent is hereby corrected as shown below:

Column 1, line 7, delete "privides" and insert ---- provides ----.

Column 2, line 1, delete "2,383,805" and insert ---- 2,382,805 ----.

Column 3, line 12, delete "through" and insert ---- though ----.

Column 3, line 21, delete "autombiles" and insert ---- automobiles ----.

Column 4, line 21, delete "showning" and insert ---- showing ----.

Column 5, line 8, delete "puching" and insert ---- pushing ----.

Column 7, line 25, delete "unitary".

Column 8, line 24, delete "members" and insert ---- components ----.

UNITED STATES PATENT AND TRADEMARK OFFICE

CERTIFICATE OF CORRECTION

PATENT NO. : 4,824,385

DATED : April 25, 1989

INVENTOR(S) : Ronald P. Sturdevan

It is certified that error appears in the above-identified patent and that said Letters Patent is hereby corrected as shown below:

Column 10, line 10, delete "unitary".

Column 10, line 11, delete "unitary".

Signed and Sealed this

Sixth Day of March, 1990

*Attest:*

*Attesting Officer*

JEFFREY M. SAMUELS

*Acting Commissioner of Patents and Trademarks*